US006111344A

United States Patent [19]

Binder et al.

[11] Patent Number: 6,111,344

[45] Date of Patent: Aug. 29, 2000

[54] INCANDESCENT LAMP WITH REFLECTION COATING

[75] Inventors: Ulrich Binder, Munich; Sigbert Mueller, Neusaess, both of Germany

[73] Assignee: Patent-Treuhand-Gesellschaft Fuer Elektrische Gluehlampen mbH, Munich, Germany

[21] Appl. No.: 09/142,580

[22] PCT Filed: Jan. 19, 1998

[86] PCT No.: PCT/DE98/00150

§ 371 Date: Sep. 11, 1998

§ 102(e) Date: Sep. 11, 1998

[87] PCT Pub. No.: WO98/32158

PCT Pub. Date: Jul. 23, 1998

[30] Foreign Application Priority Data

Jan. 20, 1997 [DE] Germany ..... 197 01 794

[51] Int. Cl.[7] ..... H01J 5/16

[52] U.S. Cl. ..... 313/113; 313/635

[58] Field of Search ..... 313/113, 115, 313/635, 634

[56] References Cited

U.S. PATENT DOCUMENTS 4,041,344 8/1977 LaGiusa .
4,160,929 7/1979 Thorington et al. .
4,988,911 1/1991 Miller .

FOREIGN PATENT DOCUMENTS 0237104 9/1987 European Pat. Off. .
0281185 9/1988 European Pat. Off. .
0470496 2/1992 European Pat. Off. .
3035068 4/1981 Germany .
4420607 12/1995 Germany .
2082383 3/1982 United Kingdom .
2144579 3/1985 United Kingdom .

*Primary Examiner*—Vip Patel
*Attorney, Agent, or Firm*—Carlo S. Bessone

[57] ABSTRACT

An electric filament incandescent in lamp, in particular a halogen incandescent lamp (9) with a rotationally symmetrical lamp bulb (10) and I.R. radiation reflecting coating (14), has an ellipsoidal partial contour. The ellipsoidal partial contour of the lamp bulb is produced by an elliptical section, the large semiaxis, and, consequently focal axis of which is oriented vertically to the longitudinal axis, i.e. vertically to the rotational axis of the lamp bulb (10). The length of the large semiaxis (a) lies preferably in the range $R<a<R+5\cdot w_r$, wherein R and $w_r$ respectively stand for the greatest radius of the lamp bulb (10) and the radius of the cylindrical luminous element (15). The lamp (9) is characterized by uniform back reflection of the I.R. radiation onto the cylindrical luminous element (15) arranged centrically on-axis inside the lamp bulb (10), and thus by a regular temperature distribution, as well as by increased lamp efficiency.

20 Claims, 3 Drawing Sheets

State of Art

INCANDESCENT LAMP WITH REFLECTION COATING

TECHNICAL FIELD

The invention proceeds from an incandescent lamp, in particular a halogen incandescent lamp having an IR reflective layer in accordance with the preamble of claim 1.

This type of lamp is used both in normal lighting systems and for special lighting purposes and also, in combination with a reflector, in projection technology, for example.

In conjunction with a layer which is applied to its inner and/or out er surface and reflects IR radiation referred to below for short as IR layer—,the rotationally symmetrical shape of the lamp bulb has the effect that a major part of the IR radiant power radiated by the luminous element is retroreflected. The rise thereby achieved in the lamp efficiency can be used, for one thing, to increase the temperature of the luminous element for a constant electric power consumption, and therefore to increase the luminous flux. On the other hand, a prescribed luminous flux can be achieved with a smaller electric power consumption—an advantageous "energy-saving effect". A further desirable effect is that because of the IR layer much less IR radiant power is radiated through the lamp bulb, and so the environment is heated much less than with conventional incandescent lamps.

Because of the unavoidable absorption losses in the IR layer, the power density of the IR radiation components inside the lamp bulb decreases with the number of reflections, and therefore so does the efficiency of the incandescent lamp, as well. Consequently, what is decisive for the increase in efficiency which can actually be achieved is to minimize the number of reflections required for returning the individual IR rays to the luminous element. The lamp bulb provided with the IR layer is specially shaped for this purpose.

PRIOR ART

This type of lamp is disclosed, for example, in U.S. Pat. No. 4,160,929, EP-A 0 470 496, DE-A 30 35 068 and DE-A 44 20 607. U.S. Pat. No. 4,160,929 teaches that optimization of the lamp efficiency requires the geometrical shape of the luminous element to be adapted to that of the lamp bulb. Moreover, the luminous element should be positioned as exactly as possible at the optical center of the lamp bulb. As a result, a wave front emanating from the surface of the luminous element is retroreflected undisturbed at the bulb surface. Aberration losses are thereby minimized. In the ideal case, a spherical lamp bulb, for example, should have a centrally arranged, likewise spherical luminous element. However, because of the restricted ductility of the tungsten wire generally used therefor, appropriate filament shapes can only be realized in a very limited fashion. A cubic filament is proposed as a coarse but feasible approximation to a sphere. In a further embodiment, the filament has the largest diameter at its center. Said diameter decreases successively towards both ends of the filament. It is proposed for an ellipsoidal bulb shape to arrange one luminous element each at the two focal points of the ellipsoid.

EP-A 0 470 496 discloses a lamp with a spherical bulb at the center of which a cylindrical luminous element is arranged. This reference teaches that the loss in efficiency owing to the deviation of the luminous element from the ideal spherical shape can be limited to an acceptable degree under the following preconditions. Either the bulb diameter and luminous element diameter or length must be tuned to one another carefully inside a tolerance range, or else the diameter of the luminous element must be conspicuously smaller (smaller by a factor of 0.05) than that of the lamp bulb. Moreover, a lamp with an ellipsoidal bulb is specified on whose focal line an elongated luminous element is axially arranged.

DE-A 30 35 068 specifies a teaching on minimizing the aberration losses, which are also unavoidable in the case of the last named embodiment. According to this reference, the two focal points of the ellipsoidal lamp bulb are on the axis of the cylindrical luminous element and at prescribed distances from the respective ends thereof.

Finally, DE-A 44 20 607 discloses a halogen incandescent lamp having a lamp bulb which has the shape of an ellipsoidal or ellipsoid-like barrel member and is provided with an IR layer. The ellipsoidal or, possibly, ellipsoid-like part of the contour of the barrel member is generated by a segment of an ellipse whose semiminor axis b is perpendicular to the lamp longitudinal axis, that is to say the rotation axis of the lamp bulb.

Moreover, the semiminor axis of the generatrix is smaller than half the bulb diameter D/2 and is displaced parallel to the rotation axis by approximately the radius d/2 of the luminous element, resulting finally in the barrel member. The length of the luminous element corresponds approximately to the spacing of the two focal points of the generating segment of the ellipse. Moreover, the luminous element is positioned inside the lamp bulb such that—in the representation of a longitudinal section—the two focal points approximately coincide with the two corresponding corner points of the luminous element. However, the filament is unevenly heated as a result. Also disadvantageous in this solution is that the achievable improvement in the lamp efficiency depends relatively strongly on the dimensioning and positioning of the luminous element inside the lamp bulb.

SUMMARY OF THE INVENTION

It is the object of the invention to eliminate the said disadvantages and to specify an incandescent lamp which is distinguished by an efficient return of the emitted IR radiation to the luminous element, and therefore by a high efficiency. Moreover, the aim is to render compact lamp dimensions possible in conjunction with high luminous densities, as is the aim, in particular, for low-voltage halogen incandescent lamps.

This object is achieved according to the invention by means of the characterizing features of claim 1. Further advantageous features of the invention are explained in the dependent claims. Reference is made below to FIG. 1 for the purpose of explaining the concept of the invention. The figure shows a diagrammatic representation of the principles of the relationships and introduces some variables essential for understanding the invention. It shows, inter alia, an ellipse 1 with the semimajor and semiminor axes a and b, respectively, as well as with the two focal points $F_1$ and $F_2$.

According to the invention, the contour of the rotationally symmetrical lamp bulb 2 (represented very diagrammatically; to simplify matters, the supply leads and the pinch(s) are not represented) is essentially generated by a segment 3 (emphasized in FIG. 1 in bold) of the ellipse 1, the segment 3 of the ellipse purposefully being selected such that the semimajor axis a is orientated perpendicular to the rotation axis RA of the lamp bulb 2. A luminous element 4 with a rotationally symmetrical, for example circular cylindrical, outer contour (represented as a rectangle in the diagrammatic longitudinal section of FIG. 1) is arranged centrally axially inside the lamp bulb 2. As a result, the focal axis $\overline{F_1F_2}$—that is, the straight line connecting the two focal points $F_1$, $F_2$ of the generatrix 3—is orientated perpendicular to the rotation axis RA of the lamp bulb 2. In particular, the semimajor axis a of the generatrix is longer than the radius R of the lamp bulb 2. Consequently, the lamp bulb 2 no longer has the shape of a "true" ellipsoid of revolution. Surprisingly, it has proved that this departure from the previous teaching results in a conspicuous increase in the lamp efficiency and a more uniform heating of the luminous element 4.

With regard to a high efficiency, it has, moreover, proved to be advantageous if the length of the semimajor axis a is selected from the range of $R<a<R+5\cdot w_r$, in particular from the range of $R+w_r \leqq a<R+3\cdot w_r$. Here, R and $w_r$ denote the largest radius of the lamp bulb 2 and the radius of the cylindrical or cylinder-like luminous element 4, respectively. The semiminor axis b of the generating segment 3 of an ellipse is approximately twice the length of the luminous element 4.

The difference to the prior art becomes apparent upon comparison with the diagrammatic representations of principle in FIGS. 2*a* and 2*b*. FIG. 2*a* corresponds essentially to the relationships in DE-A 30 35 068. This shows an ellipsoidal lamp bulb 5 in whose interior a luminous element 6 is arranged centrally axially in such a way that the two focal points $F_1$ and $F_2$ of the ellipsoid of revolution coincide with the ends of the luminous element 6. The focal axis $\overline{F_1F_2}$ is therefore orientated parallel to the rotation axis RA of the lamp bulb 5, by contrast with the present invention.

Finally, FIG. 2*b* reproduces the relationships in DE-A 44 20 607. Here, the lamp bulb 7 is in the shape of an ellipsoidal or ellipsoid-like barrel member. In the diagrammatic sectional representation, two half ellipses are to be seen which are interconnected by means of two rectilinear pieces. In this case, the pairs of focal points $F_1$, $F_2$ and $F_1'$, $F_2'$ of the two half ellipses coincide with the corner points of the luminous element 8. Consequently, the focal axes $\overline{F_1F_2}$ and $\overline{F_1'F_2'}$—once again in contrast with the present invention—are orientated parallel to the rotation axis RA of the lamp bulb.

An advantage of the present invention is—apart from the increase in efficiency—the likewise increased uniformity with which the IR radiation is retroreflected onto the filament. The result of this is to avoid instances of local overheating, which can lead to premature destruction of the filament. It is also advantageous that, by comparison with DE-A 44 20 607, the achievable improvement in the lamp efficiency depends less on production-induced fluctuations in the positioning of the luminous element inside the bulb.

Axially arranged single-coil or double-coil filaments made from tungsten are used as luminous element. The geometrical dimensioning, that is to say the diameter, lead and length depend, inter alia, on the target electrical resistance R of the filament, and this depends, in turn, on the desired electric power consumption P for a given supply voltage U. Because $P=U^2/R$, the filaments are longer in the case of high-voltage (HV) lamps as a rule than in the case of low-voltage (LV) types.

The luminous element is connected in an electrically conducting fashion to two supply leads which are guided outward in a gas-tight fashion either both in common at one end of the lamp bulb, or else separately at the two opposite ends of the lamp bulb. The sealing is generally formed by means of a pinch. However, it is also possible to have another sealing technique, for example a flare mount. The embodiment sealed at one end is suitable, in particular, for LV applications. In this case, very compact lamp dimensions can be implemented on the basis of the relatively short luminous elements.

It is advantageous for the purpose of optimizing the efficiency of the lamp if as large a portion as possible of the bulb wall can be used as an effective reflecting surface. This can be implemented, in particular, by virtue of the fact that the lamp bulb has a lamp neck at one or, if appropriate, at both ends in the region of the electrical feedthrough. The lamp neck surrounds the electrical feedthrough as narrowly as possible and merges into a seal. Details on this are to be found in DE-A 44 20 607.

The lamp bulb is usually filled with inert gas, for example with $N_2$, Xe, Ar and/or Kr. In particular, it contains halogen additives which maintain a tungsten-halogen cycle in order to counteract bulb blackening. The lamp bulb consists of a transparent material, for example silica glass.

The lamp can be operated with an outer bulb. If a particularly large reduction is desired in the IR power radiated into the environment, said outer bulb can also have an IR layer.

The IR layer can be designed, for example, as an interference filter known per se—usually a sequence of alternating dielectric layers of different refractive indices. The principle of the design of suitable IR layers is explained, for example, in EP-A 0 470 496.

DESCRIPTION OF THE DRAWINGS

The invention is to be explained in more detail below with the aid of several exemplary embodiments. In the drawing.

Figure 3:
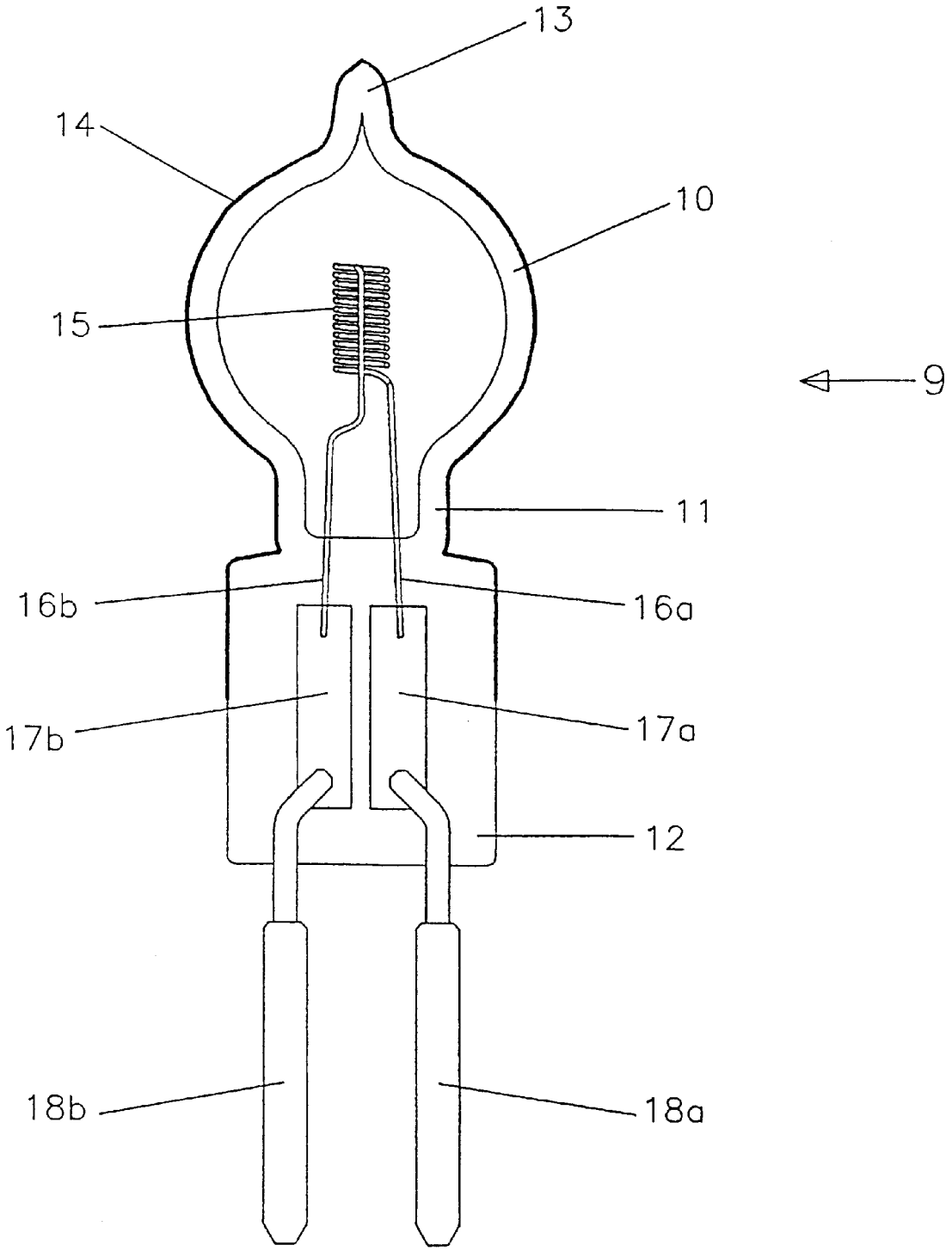
FIG. 3 shows an exemplary embodiment of an LV halogen incandescent lamp having an IR layer and a filament with internal return, as well as a bulb shape optimized according to the invention.

A first exemplary embodiment of a lamp 9 according to the invention is represented diagrammatically in FIG. 3. This is a halogen incandescent lamp having a nominal voltage of 12 V and a nominal power of 35 W. It comprises a lamp bulb 10 which is pinched at one end and is in the shape of an ellipsoid-like member. The generatrix of the ellipsoidal partial contour of the lamp bulb 10 is a segment of an ellipse whose semimajor axis is 7.4 mm long and is arranged perpendicular to the longitudinal axis of the lamp 9. The semiminor axis of the generatrix is 6.3 mm long. The lamp bulb 10 is made from silica glass with a wall thickness of approximately 1 mm, and has a maximum outside diameter of 12 mm. At its first end, the lamp bulb 10 merges into a neck 11 which ends in a pinch seal 12. At its other end, the lamp bulb 10 has a pumping tip 13. Applied to its outer surface is an IR layer 14 consisting of an interference filter having more than 20 layers of $TiO_2$ and $SiO_2$. Moreover, the IR layer also additionally covers approximately half of the pinch seal 12. In this way, on the one hand a particularly dimensionally correct form of the IR layer 14 is achieved, since during the production of the lamp bulb 10 the outer surface thereof is impressed with the calculated contour of the ellipsoidal member. On the other hand, owing to the extension of the IR layer 14 onto a portion of the pinch seal 12, the individual layers are particularly uniform in the region of the bulb surface. This reduces color errors. The length of the lamp neck 11 is approximately 2.5 mm for an outside diameter of approximately 6 mm. Located in the interior of the lamp bulb 10 is a filling made from approximately 6670 hPa xenon (Xe) nitrogen (N) mixture with a ratio of Xe:N=88:12 with an admixture of 200 ppm dibromomethane, as well as an axially arranged luminous element 15 with a length of 3.07 mm and an outside diameter of 1.87 mm. The luminous element 15 is made from tungsten wire with a diameter of 152 $\mu$m. The tungsten wire is wound with a lead of 243 $\mu$m to form a single-coil filament.

The supply leads 16*a,b* are formed directly by the filament wire and connected to molybdenum foils 17*a,b* in the pinch seal 12. The molybdenum foils 17*a,b* are connected, for their part, to external base pins 18*a,b*. The first supply lead 16*a* is guided virtually parallel to the lamp longitudinal axis and essentially aligned with the lateral surface of the luminous element 15. The second supply lead 16*b* of the luminous element 15 is bent toward the lamp longitudinal axis and extends centrally along the axis of the turns of the luminous element 15, that is to say inside the coil filament, to the end remote from the base. This avoids any shading of the radiation by a supply lead.

The lamp 9 has a color temperature of approximately 3050 K. The luminous flux is 1000 lm, corresponding to a light yield of approximately 28 lm/W. In the case of a comparable lamp without an IR layer, an electric power consumption of approximately 50 W is necessary for the same luminous flux. Consequently, by comparison therewith up to 42% of the electric power can be saved using the lamp according to the invention.

Figure 1:
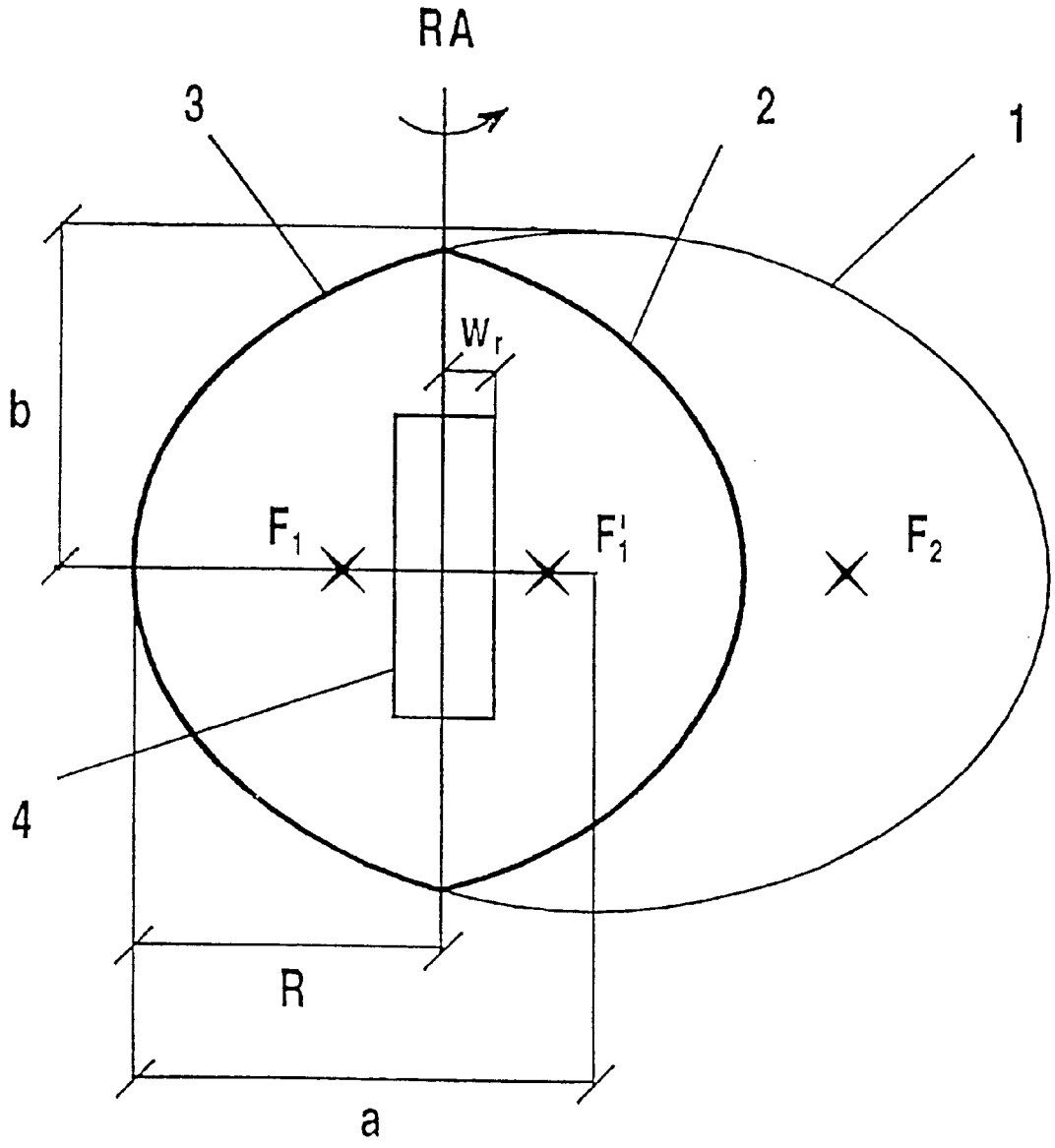
FIG. 1 shows a diagrammatic representation of the principle of the invention.
Figure 2A:
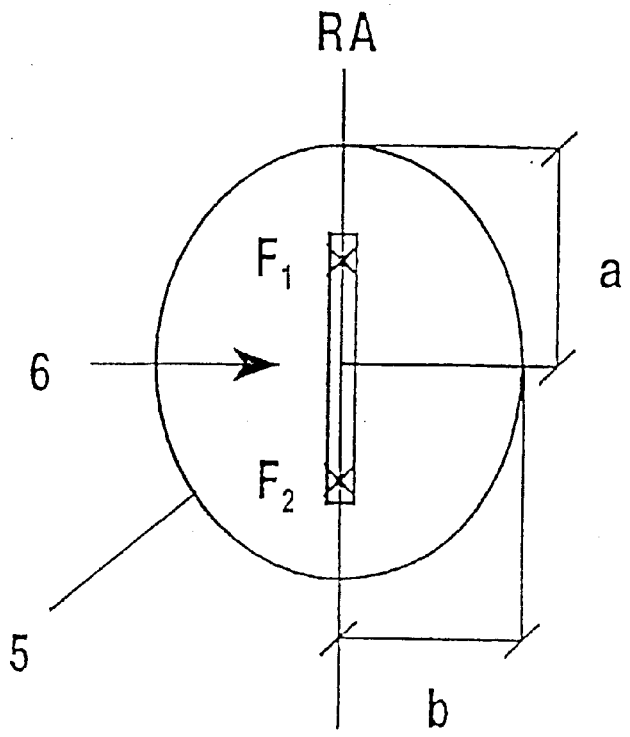
FIGS. 2*a*–2*b* show a diagrammatic representation of the prior art.
Figure 2B:
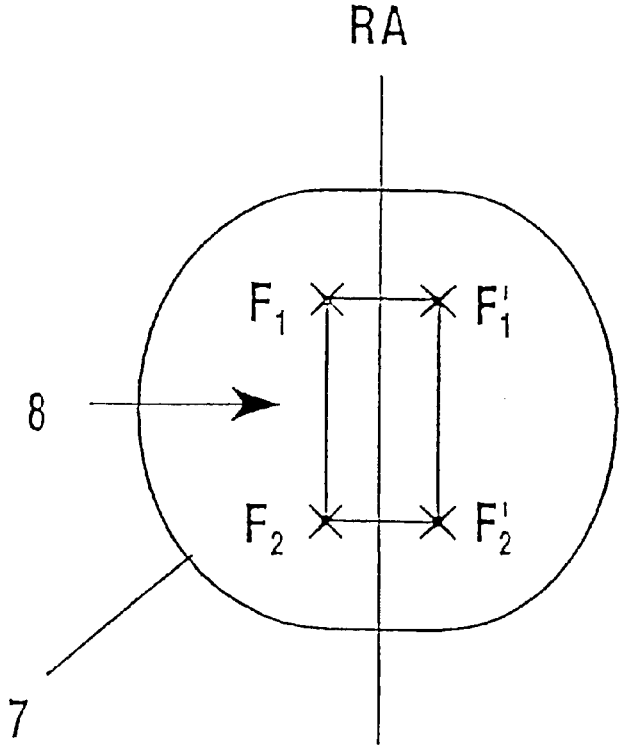

Two further exemplary embodiments for a 50 W and 65 W halogen incandescent lamp—likewise for 12 V operation—differ from one another only in the ellipse parameters of the generatrices for the lamp bulbs, as well as in the filament parameters. The design corresponds in each case to that of FIG. 1. The said parameters are compared in the following table for the three exemplary embodiments.

TABLE

Comparison of some bulb and filament parameters for three halogen incandescent lamps of different electric power consumption.

| | 35 W | 50 W | 65 W |
|---|---|---|---|
| Semimajor axis a in mm | 7.4 | 7.7 | 8.0 |
| Semiminor axis b in mm | 6.3 | 6.5 | 6.6 |
| Filament length $w_1$ in mm | 3.07 | 3.75 | 4.02 |
| Filament diameter $2w_r$ in mm | 1.87 | 1.97 | 2.3 |
| Filament lead in $\mu$m | 243 | 297 | 346 |
| Wire diameter in $\mu$m | 152 | 185 | 216 |

What is claimed is:

1. An electric incandescent lamp, in particular a halogen incandescent lamp (9), having a rotationally symmetrical lamp bulb (2; 10) which has a longitudinal axis and an ellipsoidal partial contour and in it which a wall surface is provided with a layer (14) which reflects IR radiation, and having a rotationally symmetrical luminous element (4; 15) which is arranged axially inside the lamp bulb (2; 10) and held by means of two supply leads (16*a*, 16*b*), the two supply leads (16*a*, 16*b*) being guided outward in a gas-tight fashion on one or on both sides of the lamp bulb (10) by means of one or, possibly, two seals (12), wherein the ellipsoidal partial contour of the lamp bulb (2; 10) is produced by a segment (3) of an ellipse whose semimajor axis a and, consequently, whose focal axis ($\overline{F_1F_2}$) is orientated perpendicular to the longitudinal axis, that is to say perpendicular to the rotation axis (RA) of the lamp bulb (2; 10).

2. The electric incandescent lamp as claimed in claim 1, wherein the semimajor axis a of the segment (3) of an ellipse producing the partial contour is longer than the largest radius R of the lamp bulb (2; 10), that is to say a>R.

3. The electric incandescent lamp as claimed in claim 2, wherein the layer (14) is applied to the outer surface of the lamp (9) and covers the lamp bulb (10) as well as at least a portion of the seal(s) (12).

4. The electric incandescent lamp as claimed in claim 2, wherein the length of the semiminor axis b of the segment (3) of an ellipse producing the partial contour is in the following range: $W_1/2<b<3\cdot w_1$, the variable $w_1$ denoting the length of the luminous element (4; 15).

5. The electric incandescent lamp as claimed in claim 2, wherein in the case of the single-ended seal (12) of the lamp bulb (10) the luminous element is implemented by a coil filament (15) whose supply lead (16*b*) remote from the seal is guided back inside the coil filament (15).

6. The electric incandescent lamp as claimed in claim 2, wherein at least at one end the lamp bulb (10) has a lamp neck (11) which surrounds at least one supply lead (16*a*; 16*b*) as narrowly as possible and whose end remote from the bulb is sealed in a gas-tight fashion.

7. The electric incandescent lamp as claimed in claim 2, wherein the length of the semimajor axis a is in the range of $R<a<R+5\cdot w_r$, R and $w_r$ denoting the largest radius of the lamp bulb (2; 10) and the largest radius of the rotationally symmetrical luminous element (4; 15), respectively.

8. The electric incandescent lamp as claimed in claim 7, wherein the layer (14) is applied to the outer surface of the lamp (9) and covers the lamp bulb (10) as well as at least a portion of the seal(s) (12).

9. The electric incandescent lamp as claimed in claim 7, wherein the length of the semiminor axis b of the segment (3) of an ellipse producing the partial contour is in the following range: $W_1/2<b<3\cdot w_1$, the variable $w_1$ denoting the length of the luminous element (4; 15).

10. The electric incandescent lamp as claimed in claim 7, wherein in the case of the single-ended seal (12) of the lamp bulb (10) the luminous element is implemented by a coil filament (15) whose supply lead (16*b*) remote from the seal is guided back inside the coil filament (15).

11. The electric incandescent lamp as claimed in claim 7, wherein at least at one end the lamp bulb (10) has a lamp neck (11) which surrounds at least one supply lead (16*a*; 16*b*) as narrowly as possible and whose end remote from the bulb is sealed in a gas-tight fashion.

12. The electric incandescent lamp as claimed in claim 3, wherein the length of the semimajor axis a is in the range of $R+w_r<a<R+3\cdot w_r$.

13. The electric incandescent lamp as claimed in claim 12, wherein in the case of the single-ended seal (12) of the lamp bulb (10) the luminous element is implemented by a coil filament (15) whose supply lead (16*b*) remote from the seal is guided back inside the coil filament (15).

14. The electric incandescent lamp as claimed in claim 4, wherein at least at one end the lamp bulb (10) has a lamp neck (11) which surrounds at least one supply lead (16*a*; 16*b*) as narrowly as possible and whose end remote from the bulb is sealed in a gas-tight fashion.

15. The electric incandescent lamp as claimed in claim 12, wherein the length of the semiminor axis b of the segment (3) of an ellipse producing the partial contour is in the following range: $W_1/2<b<3\cdot w_1$, the variable $w_1$ denoting the length of the luminous element (4; 15).

16. The electric incandescent lamp as claimed in claim 1, wherein the layer (14) is applied to the outer surface of the lamp (9) and covers the lamp bulb (10) as well as at least a portion of the seal(s) (12).

17. The electric incandescent lamp as claimed in claim 16, wherein at least at one end the lamp bulb (10) has a lamp neck (11) which surrounds at least one supply lead **(16*a*; 16*b*)** as narrowly as possible and whose end remote from the bulb is sealed in a gas-tight fashion.

18. The electric incandescent lamp as claimed in claim 1, wherein the length of the semiminor axis b of the segment (3) of an ellipse producing the partial contour is in the following range: $W_1/2<b<3\cdot w_1$, the variable $w_1$ denoting the length of the luminous element (4; 15).

19. The electric incandescent lamp as claimed in claim 1, wherein in the case of the single-ended seal (12) of the lamp bulb (10) the luminous element is implemented by a coil filament (15) whose supply lead **(16*b*) remote from the seal is guided back inside the coil filament (15)**.

20. The electric incandescent lamp as claimed in claim 1, wherein at least at one end the lamp bulb (10) has a lamp neck (11) which surrounds at least one supply lead **(16*a*; 16*b*)** as narrowly as possible and whose end remote from the bulb is sealed in a gas-tight fashion.

* * * * *